US011680223B2

(12) United States Patent
Tsuneoka et al.

(10) Patent No.: US 11,680,223 B2
(45) Date of Patent: Jun. 20, 2023

(54) LUBRICATING OIL COMPOSITION

(71) Applicant: ENEOS Corporation, Tokyo (JP)

(72) Inventors: Hideo Tsuneoka, Tokyo (JP); Shintaro Kusuhara, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/536,431

(22) Filed: Nov. 29, 2021

(65) Prior Publication Data

US 2022/0177804 A1 Jun. 9, 2022

(30) Foreign Application Priority Data

Dec. 7, 2020 (JP) ..... JP2020-202745

(51) Int. Cl.

| | |
|---|---|
| ***C10M 169/04*** | (2006.01) |
| ***C10M 129/74*** | (2006.01) |
| ***C10M 137/10*** | (2006.01) |
| ***C10M 135/10*** | (2006.01) |
| ***C10M 133/44*** | (2006.01) |
| ***C10M 141/10*** | (2006.01) |
| ***C10M 129/72*** | (2006.01) |
| *C10N 30/00* | (2006.01) |
| *C10N 40/25* | (2006.01) |
| *C10N 10/04* | (2006.01) |

(52) U.S. Cl.

CPC ..... *C10M 169/04* (2013.01); *C10M 129/72* (2013.01); *C10M 129/74* (2013.01); *C10M 133/44* (2013.01); *C10M 135/10* (2013.01); *C10M 137/10* (2013.01); *C10M 141/10* (2013.01); *C10M 2203/003* (2013.01); *C10M 2207/282* (2013.01); *C10M 2207/283* (2013.01); *C10M 2209/084* (2013.01); *C10M 2215/30* (2013.01); *C10M 2219/046* (2013.01); *C10M 2223/045* (2013.01); *C10N 2010/04* (2013.01); *C10N 2030/42* (2020.05); *C10N 2030/44* (2020.05); *C10N 2040/255* (2020.05)

(58) Field of Classification Search

CPC ..... C10M 169/04; C10M 129/72; C10M 133/44; C10M 135/10; C10M 137/10; C10M 2219/046; C10M 2223/045; C10N 2040/255

See application file for complete search history.

(56) References Cited

U.S. PATENT DOCUMENTS

| | | | | |
|---|---|---|---|---|
| 2008/0096776 | A1* | 4/2008 | Carrick | C10M 141/12 508/192 |
| 2018/0066203 | A1* | 3/2018 | Dance | C10M 135/10 |
| 2018/0148663 | A1* | 5/2018 | Andoh | C10M 163/00 |
| 2018/0237722 | A1* | 8/2018 | Burns, III | C10M 161/00 |
| 2018/0334636 | A1* | 11/2018 | Hoshino | C10M 101/00 |
| 2019/0256792 | A1* | 8/2019 | Kubo | C10M 137/04 |
| 2019/0330555 | A1* | 10/2019 | Yang | C10M 163/00 |
| 2019/0352575 | A1* | 11/2019 | Kubo | C10M 139/00 |
| 2019/0390134 | A1* | 12/2019 | Chommeloux | C10M 159/22 |
| 2020/0080017 | A1* | 3/2020 | Abraham | C10M 135/36 |
| 2020/0208074 | A1* | 7/2020 | Jones | C10M 141/12 |
| 2021/0189284 | A1* | 6/2021 | Shimodate | C10M 141/12 |
| 2022/0119726 | A1* | 4/2022 | Faure | C10M 129/68 |
| 2022/0119727 | A1* | 4/2022 | Cunningham | C10M 137/04 |

FOREIGN PATENT DOCUMENTS

| | | | |
|---|---|---|---|
| CN | 1524933 | A | 9/2004 |
| CN | 101646758 | A | 2/2010 |
| CN | 101821368 | A | 9/2010 |
| CN | 107541317 | A | 1/2018 |
| CN | 108473905 | A | 8/2018 |
| JP | 2001-342486 | A | 12/2001 |
| JP | 2003-165991 | A | 6/2003 |
| JP | 2017-160366 | | 9/2017 |
| JP | 2018-111779 | A | 7/2018 |
| WO | 2009/118984 | A1 | 10/2009 |

OTHER PUBLICATIONS (https://www.financialexpress.com/auto/bike-news/home-made-motorcycles-with-car-engines-desi-jugaad-of-maruti-800-engine-on-two-wheels/1108620/ (Year: 2018).*

Wang Wen, Li et al., "Effect of Engine Oil Component on Oil Viscosity and Coking Tendency under High Temperature Conditions", Lubrication Engineering, Jul. 31, 2020 vol. 45 No. 7, pp. 105-110.

Hu Jianqiang, et al., "Study on Synergistic Properties of Sulfur— and Phosphorus-Free Organic Molybdenum Compounds", Petroleum Processing and Petrochemicals, Nov. 12, 2013 vol. 44, No. 11, pp. 86-90, translation.

* cited by examiner

*Primary Examiner* — Ellen M McAvoy

(74) *Attorney, Agent, or Firm* — Greenblum & Bernstein, P.L.C.

(57) ABSTRACT

Disclosed is a lubricating oil composition. The lubricating oil composition contains a lubricating base oil including mineral base oil, 4 to 15 mass % of an ester compound of a monovalent or polyvalent aliphatic carboxylic acid and a monovalent or polyvalent aliphatic alcohol, 400 to 1200 mass ppm of zinc dialkyl dithiophosphate in terms of a phosphorus element, 500 to 3000 mass ppm of a calcium-based detergent in terms of a calcium element, and 50 to 1000 mass ppm of a boron-modified succinimide-based dispersant in terms of a boron element, on the basis of the total amount of the lubricating oil composition.

4 Claims, No Drawings

LUBRICATING OIL COMPOSITION

TECHNICAL FIELD

The present invention relates to a lubricating oil composition.

BACKGROUND

In the related art, it is general to divert engine oil developed for a 4-cycle gasoline engine of a four-wheeled automobile to 4-cycle gasoline engine oil (a lubricating oil composition) of a two-wheeled automobile. However, in the two-wheeled automobile, lubricating oil is shared between an engine, a clutch system, and a transmission, unlike the four-wheeled automobile, and thus, in a case where the 4-cycle gasoline engine oil of the four-wheeled automobile is directly applied to the 4-cycle gasoline engine of the two-wheeled automobile, a power transmission mechanism or the like may be affected. In particular, in fuel-efficient 4-cycle gasoline engine oil that is strongly demanded for the four-wheeled automobile, friction properties are reduced from the viewpoint of fuel efficiency, but clutch slipping may occur due to such a reduction in the friction properties.

On the other hand, in the 4-cycle gasoline engine of the two-wheeled automobile, an oil temperature of the engine oil tends to easily increase in accordance with a fact that the engine has a small size, high output, high-speed rotation, or an air-cooling type and/or a water-cooling type. In particular, in an off-road motorcycle, such a tendency is remarkable, and it has been required to suppress the clutch slipping in a high-load condition.

As the 4-cycle gasoline engine oil of the two-wheeled automobile, for example, a lubricating oil composition containing a predetermined amount of a predetermined additive is disclosed (for example, Patent Literature 1).

Patent Literature 1: JP 2003-165991

SUMMARY

However, the conventional lubricating oil composition does not have a high level of fuel efficiency and clutch friction properties.

Therefore, an object of the invention is to provide a lubricating oil composition in which fuel efficiency and clutch friction properties can be compatible.

One aspect of the invention provides a lubricating oil composition. The lubricating oil composition contains a lubricating base oil including mineral base oil, an ester compound of a monovalent or polyvalent aliphatic carboxylic acid and a monovalent or polyvalent aliphatic alcohol, a zinc dialkyl dithiophosphate, a calcium-based detergent, and a boron-modified succinimide-based dispersant. The content of the ester compound is 4 to 15 mass % based on a total amount of the lubricating oil composition. The content of the zinc dialkyl dithiophosphate is 400 to 1200 mass ppm in terms of a phosphorus element based on a total amount of the lubricating oil composition. The content of the calcium-based detergent is 500 to 3000 mass ppm in terms of a calcium element based on a total amount of the lubricating oil composition. The content of the boron-modified succinimide-based dispersant is 50 to 1000 mass ppm in terms of a boron element based on a total amount of the lubricating oil composition. According to such a lubricating oil composition, fuel efficiency and clutch friction properties can be compatible.

The ester compound may be an ester compound having two or more ester bonds. The ester compound may be an ester compound of a polyvalent aliphatic carboxylic acid and a monovalent aliphatic alcohol, in which the number of carbon atoms in an aliphatic group of the monovalent aliphatic alcohol is 8 to 13, or an ester compound of a monovalent aliphatic carboxylic acid and a polyvalent aliphatic alcohol, in which the number of carbon atoms in an aliphatic group of the monovalent aliphatic carboxylic acid is 8 to 13. By using such ester compounds as the ester compound, the fuel efficiency and the clutch friction properties can be compatible at a higher level.

Since the fuel efficiency and the clutch friction properties can be compatible in the lubricating oil composition, the lubricating oil composition can be preferably applied to a 4-cycle gasoline engine of a two-wheeled automobile.

Another aspect of the invention relates to the use of the composition described above, as 4-cycle gasoline engine oil of a two-wheeled automobile. In addition, another aspect of the invention relates to the use of the composition described above for manufacturing the 4-cycle gasoline engine oil of the two-wheeled automobile.

According to the invention, a lubricating oil composition is provided in which fuel efficiency and clutch friction properties can be compatible.

DETAILED DESCRIPTION

Hereinafter, an embodiment of the invention will be described in detail. However, the invention is not limited to the following embodiment.

Herein, each component (lubricating base oil and additives) or the like to be exemplified may be used alone, or two or more types thereof may be used in combination at an arbitrary ratio, unless otherwise noted. In a case where there are a plurality of substances corresponding to each of the components in a lubricating oil composition, the content of each of the components in the lubricating oil composition indicates the total content of the plurality of substances in the lubricating oil composition, unless otherwise noted. In a case where there are a plurality of substances in each of the components, the properties of each of the components indicate the total properties of the plurality of substances, unless otherwise noted.

Herein, the content of each of the elements based on the lubricating oil composition may be determined by directly analyzing the element of the lubricating oil composition, or may be determined by being calculated from the content of the element contained in the additive and the amount of charge.

[Lubricating Oil Composition]

A lubricating oil composition of one embodiment contains a lubricating base oil including mineral base oil, an ester compound, a zinc dialkyl dithiophosphate, a calcium-based detergent, and a boronated succinimide-based dispersant.

<Lubricating Base Oil>

(Mineral Base Oil)

The lubricating oil composition of this embodiment contains the lubricating base oil including the mineral base oil. As the mineral base oil, mineral base oil that is used in the field of general lubricating oil can be used.

Examples of the mineral base oil include a kerosene distillate obtained by the distillation of paraffin-based crude oil, naphthene-based crude oil, or aromatic crude oil; normal paraffin obtained by an extraction operation or the like from a kerosene distillate; and paraffin-based mineral oil, naphthene-based mineral oil, normal paraffin-based base oil, isoparaffin-based base oil, and aromatic base oil, which are refined by suitably combining one or two or more refinement treatments such as solvent deasphalting, solvent extraction, hydrogenolysis, hydroisomerization, solvent dewaxing, catalytic dewaxing, hydrorefining, sulfuric acid washing, and a white clay treatment, with a lubricating oil distillate obtained by the distillation of paraffin-based crude oil, naphthene-based crude oil, or aromatic crude oil, or wax such as slack wax, obtained by a lubricating oil dewaxing step, and/or synthetic wax such as Fischer-Tropsch wax and GTL wax, obtained by a gas-to-liquids (GTL) process or the like, as a raw material.

A sulfur content of the mineral base oil is preferably 100 mass ppm or less, is more preferably 50 mass ppm or less, and is even more preferably 10 mass ppm or less, on the basis of the total amount of the base oil. Note that, herein, the sulfur content indicates a value that is measured by JIS K2541 "Crude oil and petroleum products—Determination of sulfur content".

The total aromatic content of the mineral base oil is preferably 5 mass % or less, is more preferably 3 mass % or less, and is even more preferably 1 mass % or less, on the basis of the total amount of the base oil. Note that, herein, the total aromatic content indicates the total content of the aromatic series that is measured by The Japan Petroleum Institute JPI-5S-49-97 "Petroleum Product—Determination of Hydrocarbon Types—High Performance Liquid Chromatography".

The lubricating base oil may include the mineral base oil, and is capable of further including the other base oil, within a range not impairing the effect of the invention. Examples of the other base oil include synthetic base oil (here, excluding ester-based base oil corresponding to the ester compound described below), and the like. In the case of including such base oil as the lubricating base oil, the content of such base oil is not particularly limited, within a range not impairing the effect of the invention, and for example, may be 0.01 to 20 mass %, on the basis of the total amount of the lubricating base oil.

Examples of the synthetic base oil include poly$\alpha$-olefin or a hydrogenated product thereof, an isobutene oligomer or a hydrogenated product thereof, isoparaffin, alkyl benzene, alkyl naphthalene, and the like.

A kinetic viscosity of the lubricating base oil at 100° C. is preferably 4.0 $mm^2/s$ or more, is more preferably 4.5 $mm^2/s$ or more, and is even more preferably 5.0 $mm^2/s$ or more. In addition, the kinetic viscosity of the lubricating base oil at 100° C. is preferably 20 $mm^2/s$ or less, is more preferably 15 $mm^2/s$ or less, and is even more preferably 10 $mm^2/s$ or less. In a case where the kinetic viscosity of the lubricating base oil at 100° C. is in the range described above, suitable viscosity properties can be ensured, and an excellent oil film tends to be obtained in an actual operating temperature range.

A kinetic viscosity of the lubricating base oil at 40° C. is preferably 28 $mm^2/s$ or more, is more preferably 30 $mm^2/s$ or more, and is even more preferably 32 $mm^2/s$ or more. In addition, the kinetic viscosity of the lubricating base oil at 40° C. is preferably 50 $mm^2/s$ or less, is more preferably 45 $mm^2/s$ or less, and is even more preferably 40 $mm^2/s$ or less. In a case where the kinetic viscosity of the lubricating base oil at 40° C. is in the range described above, suitable viscosity properties can be ensured, and an excellent oil film tends to be obtained in the actual operating temperature range.

A viscosity index of the lubricating base oil is preferably 70 or more, is more preferably 100 or more, and is even more preferably 120 or more. In a case where the viscosity index is in the range described above, since the stability of the viscosity is ensured with respect to an external temperature, there is a tendency that an oil film can be formed stably with respect to a change in the external temperature in use. The viscosity index of the lubricating base oil, for example, may be 180 or less.

Herein, the kinetic viscosity at 40° C. and 100° C. and the viscosity index indicate values that are measured on the basis of JIS K2283:2000 "Crude petroleum and petroleum products—Determination of kinematic viscosity and calculation of viscosity index from kinematic viscosity", respectively.

A NOACK evaporation amount (250° C., 1 hour) of the lubricating base oil is preferably 15 mass % or less, is more preferably 12 mass % or less, and is even more preferably 10 mass % or less. Note that, herein, the NOACK evaporation amount indicates a value (an evaporation loss amount) that is measured on the basis of ASTM D 5800 (NOACK Test: 250° C., 1 hour).

The content of the lubricating base oil in the lubricating oil composition may be the remnant of the content of the ester compound, the zinc dialkyl dithiophosphate, the calcium-based detergent, the boronated succinimide-based dispersant, and the other additives, described below. The content of the lubricating base oil is preferably 40 mass % or more, is more preferably 50 mass % or more, is even more preferably 55 mass % or more, and is particularly preferably 60 mass % or more, on the basis of the total amount of the lubricating oil composition. In a case where the content of the lubricating base oil is 40 mass % or more, there is a tendency that a decrease in fuel efficiency due to an excessive increase in the viscosity can be prevented.

<Additive>

(Ester Compound)

The lubricating oil composition of this embodiment contains an ester compound of a monovalent or polyvalent aliphatic carboxylic acid and a monovalent or polyvalent aliphatic alcohol. As the ester compound, an ester compound that is used in the field of general lubricating oil can be used.

The monovalent aliphatic carboxylic acid may be an aliphatic carboxylic acid having an aliphatic group in which the number of carbon atoms is 1 to 24, 2 to 20, 4 to 16, or 8 to 13. The aliphatic group of the monovalent aliphatic carboxylic acid may be an aliphatic saturated hydrocarbon group (an alkyl group) or an aliphatic unsaturated hydrocarbon group. Such hydrocarbon groups may be linear or branched. Examples of the monovalent aliphatic carboxylic acid include a saturated aliphatic carboxylic acid such as methanoic acid, an ethanoic acid (an acetic acid), a propanoic acid (a propionic acid), a butanoic acid (a butyric acid, an isobutyric acid, or the like), a pentanoic acid (a valeric acid, an isovaleric acid, a pivalic acid, or the like), a hexanoic acid (a caproic acid or the like), a heptanoic acid, an octanoic acid (a caprylic acid or the like), a nonanoic acid (a pelargonic acid or the like), a decanoic acid, an undecanoic acid, a dodecanoic acid (a laurie acid or the like), a tridecanoic acid, a tetradecanoic acid (a myristic acid or the like), a pentadecanoic acid, a hexadecanoic acid (a palmitic acid or the like), a heptadecanoic acid, an octadecanoic acid (a stearic acid or the like), a nonadecanoic acid, an icosanoic acid, a henicosanoic acid, a docosanoic acid, a tricosanoic acid, a tetracosanoic acid, a pentacosanoic acid, a hexacosanoic acid, a heptacosanoic acid, an octacosanoic acid, a nonacosanoic acid, and a triacontanoic acid; an unsaturated aliphatic carboxylic acid such as a propenoic acid (an acrylic acid or the like), a propynoic acid (a propiolic acid or the like), a butenoic acid (a methacrylic acid, a crotonic acid, an isocrotonic acid, or the like), a pentenoic acid, a hexenoic acid, a heptenoic acid, an octenoic acid, a nonenoic acid, a decenoic acid, an undecenoic acid, a dodecenoic acid, a tridecenoic acid, a tetradecenoic acid, a pentadecenoic acid, a hexadecenoic acid, a heptadecenoic acid, an octadecenoic acid (an oleic acid or the like), a nonadecenoic acid, an eicosanoic acid, a heneicosanoic acid, a docosenoic acid, a tricosenoic acid, a tetracosenoic acid, a pentacosenoic acid, a hexacosenoic acid, a heptacosenoic acid, an octacosenoic acid, a nonacosenoic acid, and a triaconteneoic acid, and the like.

The polyvalent aliphatic carboxylic acid may be a divalent to hexavalent, divalent to tetravalent, or divalent or trivalent aliphatic carboxylic acid. The polyvalent aliphatic carboxylic acid may be an ethanedioic acid (an oxalic acid) or an aliphatic carboxylic acid having a (polyvalent)aliphatic group in which the number of carbon atoms is 1 to 16, 2 to 14, or 4 to 12. The aliphatic group of the polyvalent aliphatic carboxylic acid may be a polyvalent aliphatic saturated hydrocarbon group or a polyvalent aliphatic unsaturated hydrocarbon group. Such hydrocarbon groups may be linear or branched. Examples of the polyvalent aliphatic carboxylic acid include a saturated aliphatic carboxylic acid such as an ethanedioic acid (an oxalic acid), a propanedioic acid (a malonic acid), a butanedioic acid (a malonic acid), a pentanedioic acid (a glutaric acid), a hexanedioic acid (an adipic acid), a heptanedioic acid (a pimelic acid), an octanedioic acid (a suberic acid), a nonanedioic acid (an azelaic acid), a decanedioic acid (a sebacic acid), an undecanedioic acid, a dodecanedioic acid, a tridecanedioic acid, a tetradecanedioic acid, a heptadecanedioic acid, and a hexadecanedioic acid; an unsaturated aliphatic carboxylic acid such as a hexenedioic acid, a heptenedioic acid, an octenedioic acid, a nonenedioic acid, a decenedioic acid, an undecenedioic acid, a dodecenedioic acid, a tridecenedioic acid, a tetradecenedioic acid, a heptadecenedioic acid, and a hexadecenedioic acid, and the like.

The monovalent aliphatic alcohol may be aliphatic alcohol having an aliphatic group in which the number of carbon atoms is 1 to 24, 2 to 20, 4 to 16, or 8 to 13. The aliphatic group of the aliphatic alcohol may be an aliphatic saturated hydrocarbon group (an alkyl group) or an aliphatic unsaturated hydrocarbon group. Such hydrocarbon groups may be linear or branched. Examples of the monovalent aliphatic alcohol include methanol, ethanol, propanol, butanol, pentanol, hexanol, heptanol, octanol, nonanol, decanol, undecanol, dodecanol, tridecanol, tetradecanol, pentadecanol, hexadecanol, and the like.

The polyvalent aliphatic alcohol may be divalent to hexavalent, divalent to tetravalent, or divalent or trivalent aliphatic alcohol. The polyvalent aliphatic alcohol may be aliphatic alcohol having a (polyvalent) aliphatic group in which the number of carbon atoms is 1 to 16, 2 to 14, or 4 to 12. The aliphatic group of the polyvalent aliphatic alcohol may be a polyvalent aliphatic saturated hydrocarbon group or a polyvalent aliphatic unsaturated hydrocarbon group. Such hydrocarbon groups may be linear or branched. Examples of the polyvalent aliphatic alcohol include ethylene glycol, propylene glycol, neopentyl glycol, glycerin, trimethylol ethane, trimethylol propane, pentaerythritol, sorbitan, and the like.

As a combination of the monovalent or polyvalent aliphatic carboxylic acid and the monovalent or polyvalent aliphatic alcohol of the ester compound, for example, combinations (a) to (i) described below can be exemplified:

(a) an ester compound of a monovalent aliphatic carboxylic acid and a monovalent aliphatic alcohol;

(b) an ester compound of a polyvalent aliphatic carboxylic acid and a monovalent aliphatic alcohol;

(c) an ester compound of a monovalent aliphatic carboxylic acid and a polyvalent aliphatic alcohol;

(d) an ester compound of a polyvalent aliphatic carboxylic acid and a polyvalent aliphatic alcohol;

(e) an ester compound of a monovalent aliphatic carboxylic acid, and a mixture of a monovalent aliphatic alcohol and a polyvalent aliphatic alcohol;

(f) an ester compound of a polyvalent aliphatic carboxylic acid, and a mixture of a monovalent aliphatic alcohol and a polyvalent aliphatic alcohol;

(g) an ester compound of a mixture of a monovalent aliphatic carboxylic acid and a polyvalent aliphatic carboxylic acid, and a monovalent aliphatic alcohol;

(h) an ester compound of a mixture of a monovalent aliphatic carboxylic acid and a polyvalent aliphatic carboxylic acid, and a polyvalent aliphatic alcohol; and (i) an ester compound of a mixture of a monovalent aliphatic carboxylic acid and a polyvalent aliphatic carboxylic acid, and a mixture of a monovalent aliphatic alcohol and a polyvalent aliphatic alcohol.

The ester compound may be an ester compound having two or more ester bonds since fuel economy performance and clutch friction properties can be compatible at a higher level. The ester compound having two or more ester bonds, for example, may be the ester compound of the combination (b) or the combination (c). In the ester compound of the combination (b), the number of carbon atoms in an aliphatic group (for example, an alkyl group or the like) of the monovalent aliphatic alcohol is preferably 8 to 13. In the ester compound of the combination (c), the number of carbon atoms in an aliphatic group (for example, an alkyl group or the like) of the monovalent aliphatic carboxylic acid is preferably 8 to 13.

A kinetic viscosity of the ester compound at 100° C. may be 1.0 $m^2/s$ or more, 2.0 $mm^2/s$ or more, or 3.0 $mm^2/s$ or more. The kinetic viscosity of the ester compound at 100° C. may be 10 $mm^2/s$ or less, 7.5 $mm^2/s$ or less, or 6.0 $mm^2/s$ or less.

A kinetic viscosity of the ester compound at 40° C. may be 8.0 $mm^2/s$ or more, 10 $mm^2/s$ or more, or 11 $mm^2/s$ or more. The kinetic viscosity of the ester compound at 40° C. may be 40 $mm^2/s$ or less, 35 $mm^2/s$ or less, or 30 $mm^2/s$ or less.

A viscosity index of the ester compound may be 100 or more, 120 or more, or 130 or more. The viscosity index of the ester compound, for example, may be 170 or less.

The content of the ester compound is 4 to 15 mass %, on the basis of the total amount of the lubricating oil composition. In a case where the content of the ester compound is in such a range, it is possible to improve the clutch friction properties while maintaining the fuel efficiency. The content of the ester compound may be 4.1 mass % or more, 4.2 mass % or more, or 4.3 mass % or more, and may be 14.8 mass % or less, 14.6 mass % or less, or 14.4 mass % or less, on the basis of the total amount of the lubricating oil composition.

(Zinc Dialkyl Dithiophosphate)

The lubricating oil composition of this embodiment contains zinc dialkyl dithiophosphate (ZDTP) that is capable of functioning as a wear inhibitor. As the zinc dialkyl dithiophosphate, zinc dialkyl dithiophosphate that is used in the field of general lubricating oil can be used.

Examples of the zinc dialkyl dithiophosphate include a compound represented by General Formula (C) described below.

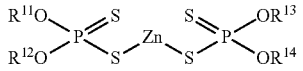

(C)

In Formula (C), $R^{11}$ to $R^{14}$ each independently indicates a linear or branched alkyl group having 1 to 24 carbon atoms. The number of carbon atoms in the alkyl group, for example, may be 2 to 12 or 3 to 8. The alkyl group may be branched.

The content of the zinc dialkyl dithiophosphate is 400 to 1200 mass ppm in terms of a phosphorus element, on the basis of the total amount of the lubricating oil composition. In a case where the content of the zinc dialkyl dithiophosphate is 400 mass ppm or more in terms of a phosphorus element, on the basis of the total amount of the lubricating oil composition, wear prevention properties tend to be more excellent. In a case where the content of the zinc dialkyl dithiophosphate is 1200 mass ppm or less in terms of a phosphorus element, on the basis of the total amount of the lubricating oil composition, catalyst poisoning tends to be further reduced. The content of the zinc dialkyl dithiophosphate may be 600 mass ppm or more or 800 mass ppm or more, and may be 1100 mass ppm or less or 1000 mass ppm or less, in terms of a phosphorus element, on the basis of the total amount of the lubricating oil composition.

(Calcium-Based Detergent)

The lubricating oil composition of this embodiment contains a calcium-based detergent that is capable of functioning as a metal-based detergent. As the calcium-based detergent, a calcium-based detergent that is used in the field of general lubricating oil can be used.

Examples of the calcium-based detergent include a neutral salt such as a sulfonate, a phenate, and a salicylate of calcium, a basic salt obtained by heating a neutral salt and a hydroxide, an oxide, or the like of calcium, in the presence of water, and a super basic salt obtained by a reaction between a neutral salt and a base such as a hydroxide of calcium, in the presence of carbon dioxide, a boric acid, a borate, or the like.

The content of the calcium-based detergent is 500 to 3000 mass ppm in terms of a calcium element, on the basis of the total amount of the lubricating oil composition. In a case where the content of the calcium-based detergent is 500 mass ppm or more in terms of a calcium element, on the basis of the total amount of the lubricating oil composition, cleanliness in an engine tends to be more excellent. In a case where the content of the calcium-based detergent is 3000 mass ppm or less in terms of a calcium element, on the basis of the total amount of the lubricating oil composition, the fuel efficiency tends to be more excellent. The content of the calcium-based detergent may be 1000 mass ppm or more or 1500 mass ppm or more, and may be 2500 mass ppm or less or 2000 mass ppm or less, in terms of a calcium element, on the basis of the total amount of the lubricating oil composition.

(Boron-Modified Succinimide-Based Dispersant)

The lubricating oil composition of this embodiment contains a boron-modified succinimide-based dispersant that is capable of functioning as an ashless dispersant. As the boron-modified succinimide-based dispersant, a boron-modified succininide-based dispersant that is used in the field of general lubricating oil can be used. By using the boron-modified succinimide-based dispersant in combination with the ester compound described above, the clutch slipping in a high-load condition can be suppressed.

Examples of the boron-modified succinimide-based dispersant include boron-modified succinimide obtained by modifying succinimide having an alkenyl group or an alkyl group to be derived from polyolefin with a boron compound such as a boric acid and a borate, and the like.

The content of the boron-modified succinimide-based dispersant is 50 to 1000 mass ppm in terms of a boron element, on the basis of the total amount of the lubricating oil composition. In a case where the content of the boron-modified succinimide-based dispersant is in such a range, the clutch friction properties tend to be more excellent. The content of the boron-modified succinimide-based dispersant may be 80 mass ppm or more or 100 mass ppm or more, and may be 500 mass ppm or less or 300 mass ppm or less, in terms of a boron element, on the basis of the total amount of the lubricating oil composition.

The lubricating oil composition of this embodiment is capable of further containing any other additives that are generally used, within a range not impairing the effect of the invention. Examples of the other additives include a friction adjuster, a metal-based detergent (here, excluding the calcium-based detergent), a wear inhibitor (here, excluding the zinc dialkyl dithiophosphate), an ashless dispersant (here, excluding the boron-modified succinimide-based dispersant), an oxidant inhibitor, a viscosity index improver, a pour-point depressant, a corrosion inhibitor, an antirust agent, a demulsifying agent, a metal deactivator, an antifoaming agent, and the like. In a case where such additives are contained in the lubricating oil composition, each content thereof is not particularly limited, within a range not impairing the effect of the invention, and for example, may be 0.01 to 30 mass %, on the basis of the total amount of the lubricating oil composition.

(Friction Adjuster)

Examples of the friction adjuster include an ashless-based friction adjuster such as an ester-based friction adjuster, an amine-based friction adjuster, an amide-based friction adjuster, a glycol-based friction adjuster, a metal-based friction adjuster such as molybdenum dithiocarbamate (MoDTC) and molybdenum dithiophosphate (MoDTP), and the like.

(Metal-Based Detergent)

Examples of the metal-based detergent include a neutral salt such as a sulfonate, a phenate, and a salicylate of an alkaline metal or an alkaline-earth metal (excluding calcium), a basic salt obtained by heating a neutral salt and a hydroxide, an oxide, or the like of an alkaline metal or an alkaline-earth metal (excluding calcium), in the presence of water, and a super basic salt obtained by a reaction between a neutral salt and a base such as a hydroxide of an alkaline metal or an alkaline-earth metal (excluding calcium), in the presence of carbon dioxide, a boric acid, a borate, or the like. Examples of the alkaline metal include sodium, potassium, and the like. Examples of the alkaline-earth metal (excluding calcium) include magnesium, barium, and the like.

(Wear Inhibitor (Extreme-Pressure Agent))

Examples of the wear inhibitor include wear inhibitors such as a sulfur-based wear inhibitor, a phosphorus-based wear inhibitor, and a sulfur-phosphorus-based wear inhibitor, More specifically, examples of the wear inhibitor include phosphorous esters, thiophosphorous esters, dithiophosphorous esters, trithiophosphorous esters, phosphoric esters, thiophosphoric esters, dithiophosphoric esters, trithiophosphoric esters, amine salts thereof, metal salts thereof (excluding the zinc dialkyl dithiophosphate), derivatives thereof, dithiocarbamate, zinc dithiocarbamate, disulfides, polysulfides, sulfurized olefins, sulfurized oil and fats, and the like.

(Ashless Dispersant)

Examples of the ashless dispersant include a nitrogen-containing compound such as succinimide having an alkenyl group or an alkyl group to be derived from polyolefin, benzyl amine, polyanine, and a Mannich base, a boron-modified nitrogen-containing compound (a boron-based ashless dispersant) (excluding the boron-modified succinimide-based dispersant) obtained by modifying such a nitrogen-containing compound with a boron compound such as a boric acid and a borate, and the like.

(Oxidant Inhibitor)

Examples of the oxidant inhibitor include an ashless oxidant inhibitor such as a phenol-based oxidant inhibitor and an amine-based oxidant inhibitor, a metal-based oxidant inhibitor such as a copper-based oxidant inhibitor and a molybdenum-based oxidant inhibitor, and the like. Examples of the phenol-based ashless oxidant inhibitor include 4,4'-methylene bis(2,6-di-tert-butyl phenol), 4,4'-bis (2,6-di-tert-butyl phenol), and the like. Examples of the amine-based ashless oxidant inhibitor include phenyl-α-naphthyl amine, alkyl phenyl-α-naphthyl amine, dialkyl diphenyl amine, diphenyl amine, and the like.

(Viscosity Index Improver)

Examples of the viscosity index improver include a poly(meth)acrylate-based viscosity index improver, an olefin copolymer-based viscosity index improver, a styrene-diene copolymer-based viscosity index improver, and the like. Such viscosity index improvers may be non-dispersive or dispersive.

(Pour-Point Depressant)

Examples of the pour-point depressant include poly (meth)acrylate-based polymers suitable for lubricating base oil to be used.

(Corrosion Inhibitor)

Examples of the corrosion inhibitor include a benzotriazole-based compound, a tolyl triazole-based compound, a thiadiazole-based compound, an imidazole-based compound, and the like.

(Antirust Agent)

Examples of the antirust agent include petroleum sulfonate, alkyl benzene sulfonate, dinonyl naphthalene sulfonate, alkenyl malonic ester, polyhydric alcohol ester, and the like.

(Demulsifying Agent)

Examples of the demulsifying agent include a polyalkylene glycol-based non-ionic surfactant such as polyoxyethylene alkyl ether, polyoxyethylene alkyl phenyl ether, and polyoxyethylene alkyl naphthyl ether, and the like. The demulsifying agent may be used alone, or two or more types thereof may be used in combination at an arbitrary ratio.

(Metal Deactivator)

Examples of the metal deactivator include imidazoline, a pyrimidine derivative, alkyl thiadiazole, mercaptobenzothiazole, benzotriazole or a derivative thereof, 1,3,4-thiadiazole polysulfide, 1,3,4-thiadiazolyl-2,5-bisdialkyl dithiocarbamate, 2-(alkyl dithio)benzoimidazole, β-(o-carboxybenzyl thio)propione nitrile, and the like.

(Antifoaming Agent)

Examples of the antifoaming agent include silicone oil of which a kinetic viscosity at 25° C. is 1000 to 100000 $mm^2/s$, an alkenyl malonic acid derivative, ester of a polyhydroxyaliphatic alcohol and a long-chain fatty acid, ester of methyl salicylate and o-hydroxybenzyl alcohol, and the like.

A kinetic viscosity of the lubricating oil composition at 100° C. is preferably 5.0 $mm^2/s$ or more, is more preferably 7.0 $mm^2/s$ or more, is even more preferably 10 $mm^2/s$ or more. In addition, the kinetic viscosity of the lubricating oil composition at 100° C. is preferably 30 $m^2/s$ or less, is more preferably 25 $mm^2/s$ or less, and is even more preferably 15 $mm^2/s$ or less. In a case where the kinetic viscosity of the lubricating oil composition at 100° C. is in the range described above, suitable viscosity properties can be ensured, and an excellent oil film tends to be obtained in an actual operating temperature range.

A kinetic viscosity of the lubricating oil composition at 40° C. is preferably 50 $mm^2/s$ or more, is more preferably 60 $mm^2/s$ or more, and is even more preferably 65 $mm^2/s$ or more. In addition, the kinetic viscosity of the lubricating oil composition at 40° C. is preferably 100 $mm^2/s$ or less, is more preferably 90 $mm^2/s$ or less, and is even more preferably 85 $mm^2/s$ or less. In a case where the kinetic viscosity of the lubricating oil composition at 40° C. is in the range described above, suitable viscosity properties can be ensured, and an excellent oil film tends to be obtained in an actual operating temperature range.

A viscosity index of the lubricating oil composition is preferably 120 or more, is more preferably 140 or more, is even more preferably 160 or more, and is particularly preferably 170 or more. In a case where the viscosity index is in the range described above, since the stability of the viscosity is ensured with respect to the external temperature, there is a tendency that an oil film can be formed stably with respect to a change in the external temperature in use. The viscosity index of the lubricating oil composition, for example, may be 220 or less.

A density of the lubricating oil composition at 15° C., for example, is preferably 0.800 g/cm or more, is more preferably 0.850 $g/cm^3$ or more, and is even more preferably 0.865 $g/cm^3$ or more, and is preferably 0.900 $g/cm^3$ or less, is more preferably 0.890 $g/cm^3$ or less, and is even more preferably 0.880 $g/cm^3$ or less. Note that, herein, the density at 15° C. indicates a density measured at 15° C., on the basis of JIS K 2249:2011.

Static friction properties of the lubricating oil composition can be evaluated by a static friction property index (SFI) obtained by a SAE No. 2 friction test based on JASO T903-2016 "Clutch Friction Property Evaluation Test Method of 4-Cycle Gasoline Engine Oil of Two-Wheeled Automobile". SFI of the lubricating oil composition, for example, may be 2.50 or more, from the viewpoint of suppressing the clutch slipping in a high-load condition. Note that, SFI being "2.50 or more" indicates a range of greater than a standard value defined as performance MA of 4-cycle gasoline engine oil of a two-wheeled automobile and indicates that the clutch friction properties are more excellent. The upper limit of SFI of the lubricating oil composition is not particularly limited, and for example, may be 3.00 or less.

Since the fuel efficiency and the clutch friction properties can be compatible in the lubricating oil composition described above, the lubricating oil composition can be preferably used in a 4-cycle gasoline engine of a two-wheeled automobile. That is, the lubricating oil composition described above may be a lubricating oil composition for the 4-cycle gasoline engine of the two-wheeled automobile. The two-wheeled automobile, for example, may be an off-road motorcycle.

EXAMPLES

Hereinafter, the invention will be described in more detail with Examples. However, the invention is not limited to such Examples.

Examples 1 to 6 and Comparative Examples 1 to 5

Lubricating oil compositions of Examples 1 to 6 and Comparative Examples 1 to 5, having compositions shown in Table 1, were prepared by using the following lubricating base oil and additives.

<Lubricating Base Oil>

(Mineral Base Oil)

A-1: mineral base oil (Group III of API Classification) (Kinetic Viscosity at 100° C.: 6.4 $mm^2/s$, Kinetic Viscosity at 40° C.: 35.6 $mm^2/s$, Viscosity Index: 133, NOACK Evaporation Amount (250° C., 1 hour): 7.4 mass %, Sulfur Content: 1 mass ppm, Total Aromatic Content: 0.4 mass %)

<Additives>

(Ester Compound)

B-1: an ester compound (Kinetic Viscosity at 100° C.: 3.5 $mm^2/s$, Kinetic Viscosity at 40° C.: 13.7 $mm^2/s$, Viscosity Index: 144) of an adipic acid (a divalent aliphatic carboxylic acid) and an isodecyl alcohol (monovalent aliphatic alcohol, Number of Carbon Atoms in Aliphatic Group: 10)

B-2: an ester compound (Kinetic Viscosity at 100° C.: 5.3 $mm^2/s$, Kinetic Viscosity at 40° C.: 26.7 $mm^2/s$, Viscosity Index: 135) of an adipic acid (a divalent aliphatic carboxylic acid) and an isotridecyl alcohol (monovalent aliphatic alcohol, Number of Carbon Atoms in Aliphatic Group: 13)

B-3: an ester compound (Kinetic Viscosity at 100° C.: 3.2 $mm^2/s$, Kinetic Viscosity at 40° C.: 11.6 $mm^2/s$, Viscosity Index: 152) of a divalent aliphatic carboxylic acid (Number of Carbon Atoms in Aliphatic Group: 10) and a 2-ethyl hexyl alcohol (monovalent aliphatic alcohol, Number of Carbon Atoms in Aliphatic Group: 8)

B-4: an ester compound (Kinetic Viscosity at 100° C.: 4.4 $mm^2/s$, Kinetic Viscosity at 40° C.: 20.0 $mm^2/s$, Viscosity Index: 140) of a monovalent aliphatic carboxylic acid (Number of Carbon Atoms in Aliphatic Group: 8 to 10) and a trimethylol propane (trivalent aliphatic alcohol)

(Zinc Dialkyl Dithiophosphate)

C-1: zinc dialkyl dithiophosphate (zinc dialkyl dithiophosphate derived from secondary alcohol having 3 to 8 carbon atoms, Content of P: 7.2 mass %, Content of S: 14.4 mass %, Content of Zn: 7.9 mass %)

(Calcium-Based Detergent)

D-1: super basic calcium sulfonate having an alkyl group having 7 to 24 carbon atoms, which is a propylene oligomer (Content of Ca: 12 mass %)

(Boron-Modified Succinimide-Based Dispersant)

E-1: a boron-modified succinimide-based dispersant (a bis type, Number Average Molecular Weight (Mn): 2700, Weight Average Molecular Weight (Mw): 7400, Content of B: 0.50 mass %)

E-2: a boron-modified succinimide-based dispersant (a mono type, Number Average Molecular Weight (Mn): 3100, Weight Average Molecular Weight (Mw): 4600, Content of B: 0.15 mass %)

(Non-Boron-Modified Succinimide-Based Dispersant)

e-1: a succinimide-based dispersant (a bis type, Number Average Molecular Weight (Mn): 5400, Weight Average Molecular Weight (Mw): 11000, Content of B: 0 mass %)

e-2: a succinimide-based dispersant (a mono type, Number Average Molecular Weight (Mn): 3600, Weight Average Molecular Weight (Mw): 4500, Content of B: 0 mass %)

(Viscosity Index Improver)

F-1: a poly(meth)acrylate-based viscosity index improver (Weight Average Molecular Weight (Mw): 30000)

(Other Additives)

Pour-Point Depressant and Antifoaming Agent

Note that, the content of elements in Table 1 is a value based on the total amount of the lubricating oil composition and is obtained by being calculated from the content of the element contained in the additive and the amount of charge. The content of a P element, the content of an S element, and the content of a Zn element are mainly a value derived from C-1. The content of a Ca element is mainly a value derived from D-1. The content of a B element is mainly a value derived from E-1 and E-2.

(1) Kinetic Viscosity and Viscosity Index

Kinetic viscosities of each of the lubricating oil compositions at 40° C. and 100° C. and a viscosity index thereof were measured on the basis of JIS K2283:2000. Results are shown in Table 1.

(2) Density

The density of each of the lubricating oil compositions at 15° C. was measured on the basis of JIS K 2249:2011. Results are shown in Table 1.

(3) SRV Friction Coefficient

An SRV friction test was performed with respect to each of the lubricating oil compositions in the following condition, by using an SRV friction tester, to measure an SRV friction coefficient. It can be said that fuel efficiency is excellent as the SRV friction coefficient is low (for example, 0.110 or less). Results are shown in Table 1.

Temperature: 80° C.

Load: 50N

Frequency: 50 Hz

Amplitude: 1.5 mm

Measurement Time: 30 minutes (4) Clutch Friction Properties

An SAE No. 2 friction test was performed on the basis of JASO T903-2016 "Clutch Friction Property Evaluation Test Method of 4-Cycle Gasoline Engine Oil of Two-Wheeled Automobile", and a friction property index including a dynamic friction property index (DFI), a static friction property index (SFI), and a stop time index (STI) was obtained. In performance MA of 4-cycle gasoline engine oil of a two-wheeled automobile, DFI is defined as 1.35 or more and less than 2.50, SFI is defined as 1.45 or more and less than 2.50, and STI is defined as 1.40 or more and less than 2.50. However, since it is necessary to increase SFI to 2.50 or more after suppressing clutch slipping in a high-load condition, it can be said that clutch friction properties are more excellent as SFI is 2.50 or more. Results are shown in Table 1.

TABLE 1

| | | | Exam. 1 | Exam. 2 | Exam. 3 | Exam. 4 | Exam. 5 | Exam. 6 |
|---|---|---|---|---|---|---|---|---|
| Lubricating base oil (based on total amount of composition) | | | | | | | | |
| Lubricating base oil | A-1 | mass % | 67.8 | 64.9 | 57.7 | 65.7 | 64.9 | 63.8 |
| Additives (based on total amount of composition) | | | | | | | | |
| Ester compound | B-1 | mass % | 4.3 | 7.2 | 14.4 | — | — | — |
| | B-2 | mass % | — | — | — | 7.3 | — | — |
| | B-3 | mass % | — | — | — | — | 7.2 | — |
| | B-4 | mass % | — | — | — | — | — | 7.1 |
| Wear inhibitor | C-1 | mass % | 1.2 | 1.2 | 1.2 | 1.2 | 1.2 | 1.2 |
| Metal-based detergent | D-1 | mass % | 1.6 | 1.6 | 1.6 | 1.6 | 1.6 | 1.6 |
| Ashless dispersant | E-1 | mass % | 1.2 | 1.2 | 1.2 | 0.6 | 1.2 | 2.0 |
| | E-2 | mass % | 0.6 | 0.6 | 0.6 | 0.3 | 0.6 | 1.0 |
| | e-1 | mass % | 3.9 | 3.9 | 3.9 | 3.9 | 3.9 | 3.9 |
| | e-2 | mass % | — | — | — | — | — | — |
| Viscosity index improver | F-1 | mass % | 19.2 | 19.2 | 19.2 | 19.2 | 19.2 | 19.2 |
| Other additives | | mass % | 0.3 | 0.3 | 0.3 | 0.3 | 0.3 | 0.3 |
| Content of element | P | mass ppm | 980 | 980 | 980 | 980 | 980 | 980 |
| | S | mass ppm | 2400 | 2400 | 2400 | 2400 | 2400 | 2400 |
| | Zn | mass ppm | 1100 | 1100 | 1100 | 1100 | 1100 | 1100 |
| | Ca | mass ppm | 1900 | 1900 | 1900 | 1900 | 1900 | 1900 |
| | B | mass ppm | 180 | 180 | 180 | 100 | 180 | 300 |
| Properties of composition | | | | | | | | |
| Kinetic viscosity | (40° C.) | $mm^2/s$ | 79.4 | 76.2 | 71.4 | 80.3 | 74.5 | 79.0 |
| | (100° C.) | $mm^2/s$ | 13.5 | 13.3 | 13.0 | 13.6 | 13.1 | 13.5 |
| Viscosity index | | | 174 | 178 | 186 | 175 | 179 | 176 |
| Density | (15° C.) | $g/cm^3$ | 0.871 | 0.872 | 0.876 | 0.870 | 0.870 | 0.872 |
| SRV friction coefficient | | | 0.106 | 0.106 | 0.105 | 0.110 | 0.106 | 0.105 |
| Clutch friction properties | Dynamic friction property index (DFI) | | 2.03 | 2.03 | 2.07 | 2.07 | 2.09 | 2.04 |
| | Static friction property index (SFI) | | 2.50 | 2.59 | 2.55 | 2.53 | 2.57 | 2.59 |
| | Stop time index (STI) | | 2.07 | 2.08 | 2.09 | 2.08 | 2.08 | 2.07 |

TABLE 2

| | | | Comp. Exam. 1 | Comp. Exam. 2 | Comp. Exam. 3 | Comp. Exam. 4 | Comp. Exam. 5 |
|---|---|---|---|---|---|---|---|
| Lubricating base oil (based on total amount of composition) | | | | | | | |
| Lubricating base oil | A-1 | mass % | 72.1 | 69.6 | 50.5 | 64.8 | 66.5 |
| Additives (based on total amount of composition) | | | | | | | |
| Ester compound | B-1 | mass % | — | 2.5 | 21.6 | 7.2 | 7.4 |
| | B-2 | mass % | — | — | — | — | — |
| | B-3 | mass % | — | — | — | — | — |
| | B-4 | mass % | — | — | — | — | — |
| Wear inhibitor | C-1 | mass % | 1.2 | 1.2 | 1.2 | 1.2 | 1.2 |
| Metal-based detergent | D-1 | mass % | 1.6 | 1.6 | 1.6 | 1.6 | 1.6 |
| Ashless dispersant | E-1 | mass % | 1.2 | 1.2 | 1.2 | — | — |
| | E-2 | mass % | 0.6 | 0.6 | 0.6 | — | — |
| | e-1 | mass % | 3.9 | 3.9 | 3.9 | 3.9 | 3.9 |
| | e-1 | mass % | — | — | — | 1.9 | — |
| Viscosity index improver | F-1 | mass % | 19.2 | 19.2 | 19.2 | 19.2 | 19.2 |
| Other additives | | mass % | 0.3 | 0.3 | 0.3 | 0.3 | 0.3 |
| Content of element | P | mass ppm | 980 | 980 | 980 | 980 | 980 |
| | S | mass ppm | 2400 | 2400 | 2400 | 2400 | 2400 |
| | Zn | mass ppm | 1100 | 1100 | 1100 | 1100 | 1100 |
| | Ca | mass ppm | 1900 | 1900 | 1900 | 1900 | 1900 |
| | B | mass ppm | 180 | 180 | 180 | <1 | <1 |
| Properties of composition | | | | | | | |
| Kinetic viscosity | (40° C.) | $mm^2/s$ | 84.7 | 81.9 | 66.6 | 76.2 | 70.0 |
| | (100° C.) | $mm^2/s$ | 13.8 | 13.6 | 12.6 | 13.3 | 12.6 |
| Viscosity index | | | 167 | 170 | 192 | 179 | 181 |
| Density | (15° C.) | $g/cm^3$ | 0.866 | 0.867 | 0.881 | 0.871 | 0.870 |
| SRV friction coefficient | | | 0.113 | 0.106 | 0.106 | 0.113 | 0.113 |
| Clutch friction properties | Dynamic friction property index (DFI) | | 2.04 | 2.01 | 2.08 | 2.02 | 2.09 |
| | Static friction property index (SFI) | | 2.45 | 2.44 | 2.48 | 2.47 | 2.38 |
| | Stop time index (STI) | | 2.05 | 2.08 | 2.09 | 2.05 | 2.09 |

As shown in Table 1 and Table 2, it was determined that in the lubricating oil compositions of Examples 1 to 6, the SRV friction coefficient is low, and the static friction property index (SFI) indicates a range of greater than a standard value defined as the performance MA of the 4-cycle gasoline engine oil of the two-wheeled automobile, compared to the lubricating oil compositions of Comparative Examples 1 to 5. From such results, it was checked that the fuel efficiency and the clutch friction properties can be compatible in the lubricating oil composition of the invention.

What is claimed is:

1. A lubrication method of lubricating a 4-cycle gasoline engine of a two-wheeled automobile comprising:

providing a lubricating oil composition comprising:

a lubricating base oil including a mineral base oil;

an ester compound of a monovalent or polyvalent aliphatic carboxylic acid and a monovalent or polyvalent aliphatic alcohol;

a zinc dialkyl dithiophosphate;

a calcium-based detergent; and a boron-modified succinimide-based dispersant, wherein;

a content of the ester compound is 4 to 15 mass % based on a total amount of the lubricating oil composition;

a content of the zinc dialkyl dithiophosphate is 800 to 1200 mass ppm in terms of a phosphorus element based on a total amount of the lubricating oil composition;

a content of the calcium-based detergent is 500 to 3000 mass ppm in terms of a calcium element based on a total amount of the lubricating oil composition; and a content of the boron-modified succinimide-based dispersant is 50 to 1000 mass ppm in terms of a boron element based on a total amount of the lubricating oil composition, and lubricating a 4-cycle gasoline engine of a two-wheeled automobile with the lubricating oil composition;

wherein the two-wheeled automobile includes a clutch system and transmission, and wherein the lubricating oil composition is shared between the engine, the clutch system, and the transmission.

2. The lubrication method according to claim 1, wherein the ester compound is an ester compound having two or more ester bonds.

3. The lubrication method according to claim 2, wherein the ester compound is an ester compound of a polyvalent aliphatic carboxylic acid and a monovalent aliphatic alcohol, in which the number of carbon atoms in an aliphatic group of the monovalent aliphatic alcohol is 8 to 13, or an ester compound of a monovalent aliphatic carboxylic acid and a polyvalent aliphatic alcohol, in which the number of carbon atoms in an aliphatic group of the monovalent aliphatic carboxylic acid is 8 to 13.

4. The lubrication method according to claim 1, wherein a static friction property index (SFI) of the lubricating oil composition is 2.50 or more.

* * * * *